US006007030A

United States Patent [19]

Judge

[11] Patent Number: 6,007,030

[45] **Date of Patent: *Dec. 28, 1999**

[54] FOLDING TRASH BAG EXPANDING FORM AND HOLDER

[76] Inventor: John A. Judge, 2241 Summit Ave., St. Paul, Minn. 55105

[ * ] Notice: This patent is subject to a terminal disclaimer.

[21] Appl. No.: 09/300,240

[22] Filed: Apr. 27, 1999

Related U.S. Application Data

[63] Continuation-in-part of application No. 09/055,428, Apr. 6, 1998, Pat. No. 5,897,084.

[51] Int. Cl.[6] ..... B65B 67/12

[52] U.S. Cl. ..... 248/95; 248/99; 141/390

[58] Field of Search ..... 248/95, 99, 97; 206/418; 141/390; 229/55

[56] References Cited

U.S. PATENT DOCUMENTS

| | | | |
|---|---|---|---|
| 2,724,606 | 2/1956 | Paige . | |
| 3,614,041 | 10/1971 | Koger . | |
| 3,983,914 | 10/1976 | Benson | 141/390 |
| 4,037,778 | 7/1977 | Boyle . | |
| 4,115,909 | 9/1978 | Corella . | |
| 4,338,979 | 7/1982 | Dow | 248/97 X |
| 4,364,490 | 12/1982 | Lang et al. . | |
| 4,413,800 | 11/1983 | Kelson . | |
| 4,457,483 | 7/1984 | Gagne' | 248/97 |
| 4,530,533 | 7/1985 | Dieter . | |
| 4,667,912 | 5/1987 | DeVilbiss . | |
| 4,723,740 | 2/1988 | Courtemanche et al. . | |
| 4,749,011 | 6/1988 | Rylander | 141/316 |
| 4,760,982 | 8/1988 | Cooke . | |
| 4,783,031 | 11/1988 | Ebentheuer . | |
| 4,890,652 | 1/1990 | Horner . | |
| 4,927,104 | 5/1990 | Miller . | |
| 4,948,266 | 8/1990 | Bencie . | |
| 4,979,547 | 12/1990 | Hoerner . | |
| 5,054,724 | 10/1991 | Hutcheson . | |
| 5,056,679 | 10/1991 | Lonczak . | |
| 5,065,965 | 11/1991 | Aulabaugh . | |
| 5,129,609 | 7/1992 | Tobin . | |
| 5,271,589 | 12/1993 | Belous . | |
| 5,292,093 | 3/1994 | Shumake . | |
| 5,716,033 | 2/1998 | Gibson . | |
| 5,897,084 | 4/1999 | Judge | 248/95 |

OTHER PUBLICATIONS

*Commercial Product*: Easy Bagger® bag holder sold after 1991 (Exhibit A).

*Primary Examiner*—Berek J. Berger
*Assistant Examiner*—Tan Le
*Attorney, Agent, or Firm*—James V. Harmon

[57] ABSTRACT

A trash bag holder and expanding form is made from a sheet of stiff material that has at least three panels to hold a bag in an erect condition and to expand the opening of the bag into a shape that will allow the user to fill the bag with leaves or trash without having to hold the bag. The panels are separated by parallel, vertically disposed score lines that act as fold lines or hinges between the panels of the holder. The holder can be formed from high density corrugated polyurethylene (HDPE) board, recycled plastic corrugated board that may have a lap joint sealed by a sonic weld. The panels are proportioned so that the sheet material can be folded flat with the panels lying against one another. When the invention is folded into its operational configuration, the score lines act as corners such that the form is tubular or U-shaped with open ends and braces may hold panels in extended opposing relationship.

10 Claims, 10 Drawing Sheets

FOLDING TRASH BAG EXPANDING FORM AND HOLDER

This application is a continuation-in-part of application Ser. No. 09/055,428 filed Apr. 6, 1998, now U.S. Pat. No. 5,897,084.

FIELD OF THE INVENTION

This invention relates to a bag expander and more particularly to a device that aids in placing refuse into a trash bag made from thin plastic film or paper especially suited for leaf gathering, mulching, and the like.

BACKGROUND OF THE INVENTION

Several devices have been proposed to hold trash bags made from paper or thin plastic film. For example, U.S. Pat. No. 4,783,031 describes a trash bag assembly and holder which is employed to hold the trash bag open while trash is placed in the bag. This device is especially useful when a person placing the trash in the bag has his or her hands full of trash and cannot hold the bag open. However, the device requires numerous metal components and is therefore expensive to produce and cannot easily be stored in a confined space. The vast majority of the other devices developed to solve this problem are complex in construction and have many parts which need assembly. Although these devices once assembled are able to hold the bag open, the assembly and disassembly times make these devices unappealing. Moreover, a significant portion of the prior art consists of devices that are made from metal wire or metal brackets. Although metal is generally sturdy, it is expensive, prone to bending and most of the metal pieces are subject to corrosion and to rusting over time. U.S. Pat. No. 5,054,724 discloses a container with four walls and a bottom, but it can only be used on the outside of a bag that has carrying handles.

Consequently, there remains a need for an inexpensive, simple, sturdy, easy to store, rustproof device that adequately holds the bag in the proper configuration to receive refuse, leaves and other trash.

In view of these and other shortcomings of the prior art, it is one object of the present invention to provide a trash bag expanding form and holder which is inexpensive to produce and yet will hold any of several sizes of non-self-supporting trash bags such as 33-, 39- and 45-gallon trash bags in an expanded condition to facilitate filling them with leaves or other trash.

Another object of the invention is to provide an expandable form for trash bags that can be readily inserted into a flimsy plastic trash bag without damaging the bag and protects the bag from being punctured, e.g. by twigs that are placed in the bag with the leaves, yet can be collapsed to form a small bundle for shipment, display or storage and is durable enough to be used by a typical household for several years.

A further object is to provide a trash bag expanding form that will hold a bag open and is capable of holding the upper edge of a flimsy bag in place near the top of the form.

These and other more detailed and specific objects of the present invention will be better understood by reference to the following figures and detailed description which illustrate by way of example but a few of the various forms of the invention within the scope of the appended claims.

SUMMARY OF THE INVENTION

The present invention provides a trash bag holder and expanding form of at least three panels and an opening at each end. Its function is to hold the bag in an erect condition and to expand the opening of the bag into a shape that will allow the user to fill the bag with leaves without having to hold the bag. The invention includes a plurality of upright panels connected by parallel, vertically disposed fold lines or hinges. The panels can be formed from any of a variety of sheet materials that are fairly stiff in character, because the invention is intended to hold the bag upright. Although it can be made from more than more than one piece of material, the invention is preferably made from a single sheet of either high density corrugated polyethylene (HDPE) board or corrugated boxboard. The sheet material is scored along several vertical lines to define fold lines for the hinged panels. The score lines are preferably parallel to one side of a rectangular blank of the sheet material so as to allow folding of the sheet along the score lines. The panels are proportioned so that the sheet material can be folded flat with the panels lying upon, i.e. against, one another. The score lines thus form the hinges between the panels of the holder. When the invention is folded into its operational configuration, the score lines act as corners such that the form takes a tubular shape. The invention, in its operational configuration, is a vertically disposed elongated tube having any number of sides. The edges of the sheet that are parallel to the score lines are placed together to create the tube. These adjacent edges may be placed adjacent one another or bonded together in any suitable way, some of which are enumerated in this application, e.g. by glue or a strip of tape. The bottom edges of the walls are preferably rounded to protect the bag from becoming snagged on the corners of the tube. The stiff panels provide a sturdy structural integrity to the expanded form.

The top part of the form contains handholds and several slits for supporting bags of different sizes. There is preferably a handhold on each side of the tube. Handholds on opposite sides are preferably at the same height with respect to the top edge of the form. The form preferably has at least two slits to hold the top of the bag in place and most preferably has slits properly positioned to enable 33-, 39-, and 45-gallon bags now on sale to be attached to the form. The slits for the small and medium sized bags can be placed within the handholds so that the bag edge can be easily secured in the slit. Two slits for a given sized bag are preferably located on panels across from one another. The slits for the large bag are preferably located at the top edge of the form. The upper portions of the slits are preferably rounded so that it is easier to mount the bag and so that the bag edge does not rip while attempting to insert the bag edge into the slit.

THE FIGURES

DESCRIPTION OF THE PREFERRED EMBODIMENTS

Figure 1:
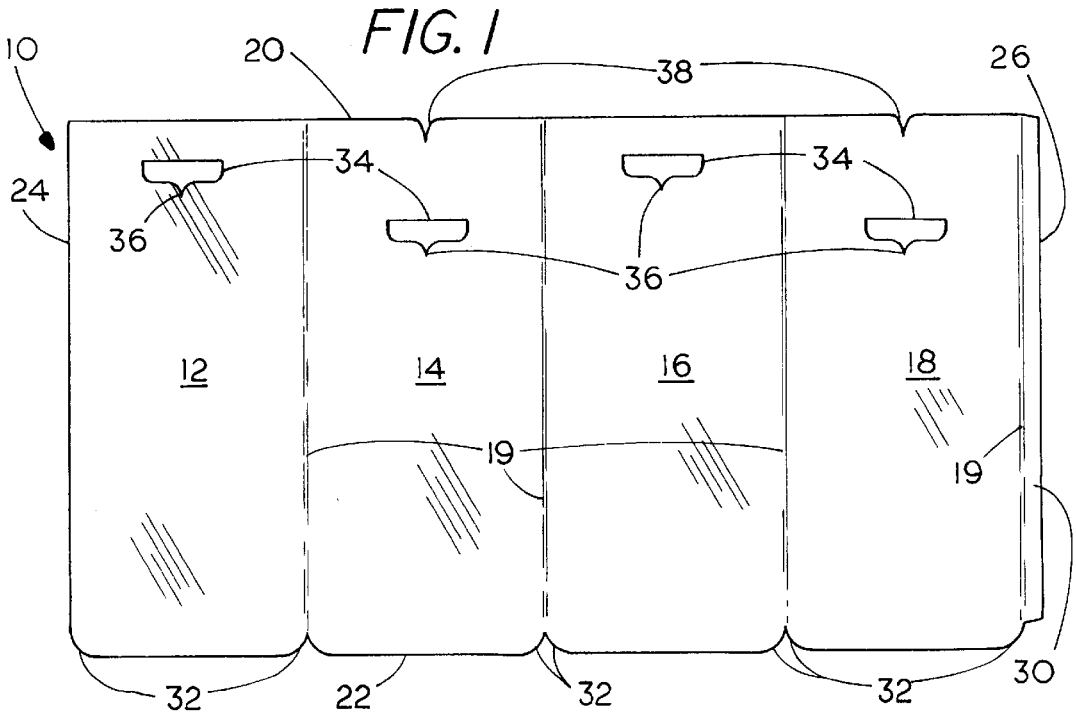
FIG. 1 is a plan view of a typical blank of a form according to the invention.

In FIG. 1 is shown a form comprising a flat sheet 10 of fairly stiff material such as paperboard, corrugated paperboard, 3.0 mm corrugated high density polyethylene (HDPE) board, recycled plastic corrugated board, laminated or non-laminated fiberboard, or corrugated boxboard, especially moisture-resistant boxboard, provided with a plurality of score lines 19 oriented parallel to the side edges 24 and 26 of the sheet 10 to define four panels 12, 14, 16 and 18. The form is sturdy enough to be self-supporting, i.e. capable of standing upright. The score lines 19 define fold lines between the panels 12–18 and a connecting tab 30 adjacent the edge 26. One of the score lines 19 is located close to the side edge 26 so as to form the connecting tab 30. The rest of the score lines 19 are parallel and are spaced uniformly across the remaining area of the sheet 10 to define panels that are equal in size. The panel 12 is defined by side edge 24, top edge 20, bottom edge 22, and the score line 19 nearest to side edge 24. The panel 12 has a handhold 34 located generally near top edge 20 and centered between the side edge 24 and first score line 19. A bag retainer comprising a slit 36 with edges that diverge proceeding upwardly and rounded upper corners is cut into the bottom edge of the handhold 34. The panel 14 is defined by the first score line 19 and the second score line from the side edge 24, the top edge 20, and the bottom edge 22. A slit 38 with rounded upwardly facing edges at each corner is cut into the top edge 20 of the sheet and is centered between the first score line and the second score line. A handhold 34 with a slit 36 is centered between the remaining score lines and is located slightly farther away from top edge 20 than the handhold on panel 12. The panel 16 is defined by the second and third score lines from the side 24, the top edge 20 and the bottom edge 22. The panel 16 has a handhold 34 and slit at the same elevation as in panel 12. The panel 18 is defined by the third and last score line 19 which provides the tab 30 along side edge 26, the top edge 20 and the bottom edge 22. The panel 18 includes a slit 38 in the top edge 20 and a handhold 34 with a slit 36 both positioned as in panel 14. The bottom edge 22 is provided with indentations aligned with score lines 19. The indentations have arcuate, outwardly arched, e.g. round, corners. The handholds 34 enable the form to be easily grasped manually to facilitate pulling it out of the bag 40 after the bag has been filled.

The bag expanding form and holder thus includes at least three panels formed from stiff sheet material, that is to say, sheet material which can support itself, a characteristic commonly referred to in the industry as "self-supporting." The panels are separated from one another by the score lines 19 which form fold lines to enable the panels to provide a tubular expander for the bag 40, with an opening at each end. The form thus has a plurality of planar panels 12, 14, 16 and 18 sized to fit the circumference of the bag 40 to thereby hold the bag 40 in its expanded condition.

Figure 2:
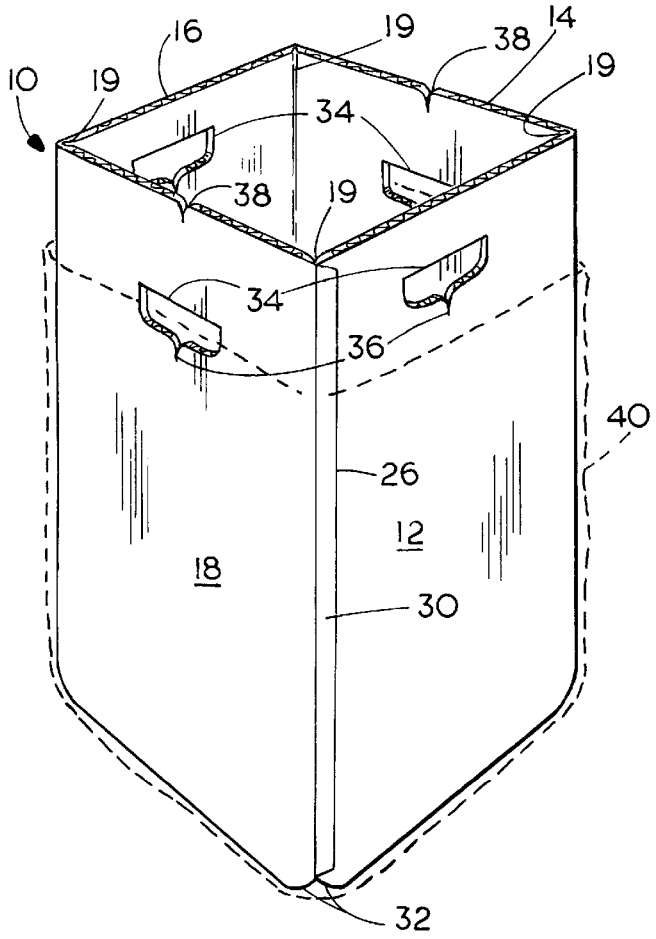
FIG. 2 is a perspective view showing the invention as it appears with a thin-walled plastic bag shown in dashed lines ready for use.

FIG. 2 shows the invention expanded and placed upright for use. Score lines 19 form the corners of a rectangular box structure with no bottom or top. The indentations 32 form the bottom corners of the box structure. A trash bag 40 is shown in dotted lines covering the lower portion of the form, generally as it appears during use. In this case the bag 40 is a flimsy, non-self-supporting trash bag.

Figure 3:
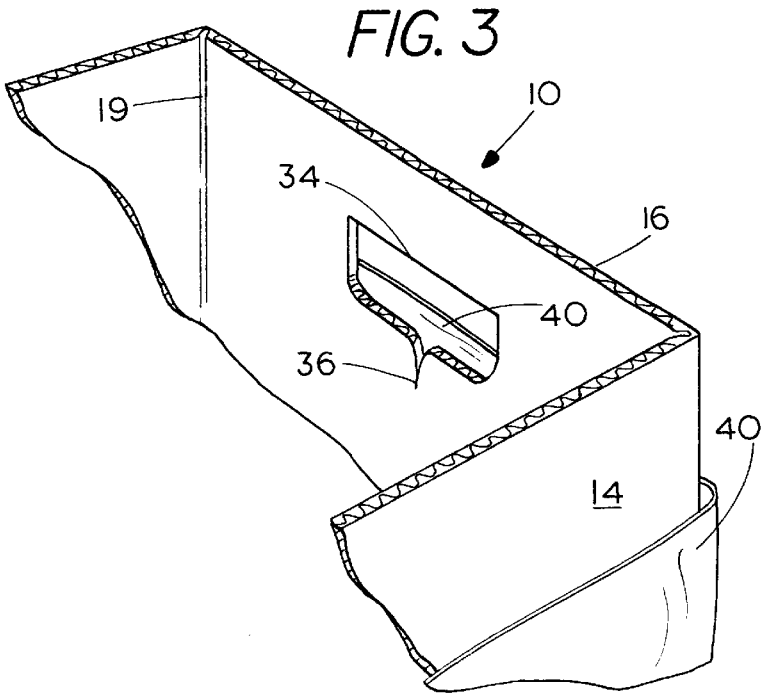
FIG. 3 is a partial perspective view on a larger scale showing the handhold for lifting the form and slit used for securing the bag in place.
Figure 4:
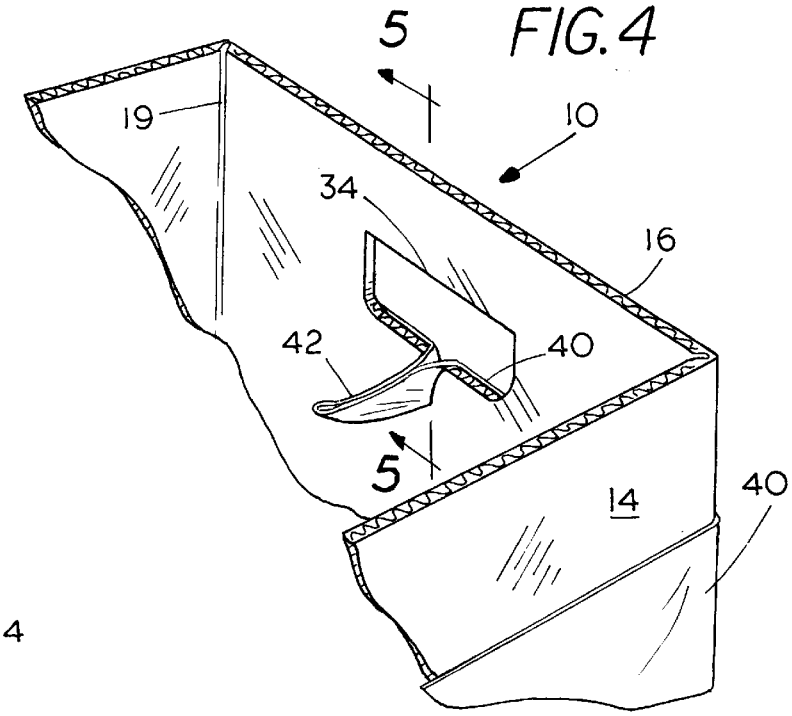
FIG. 4 is a perspective view similar to FIG. 3 showing the edge of the bag pulled through and secured in place within a retaining slit.
Figure 5:
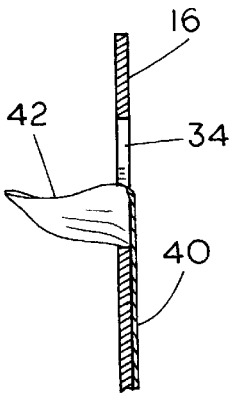
FIG. 5 is a vertical cross-sectional view taken on line 5—5 of FIG. 4.

In FIGS. 4 and 5, the upper edge 42 of the bag 40 of FIG. 3 is pulled through the handhold 34 and is securely held by being pinched in diametrically opposed slits 36 at the same elevation.

Figure 6:
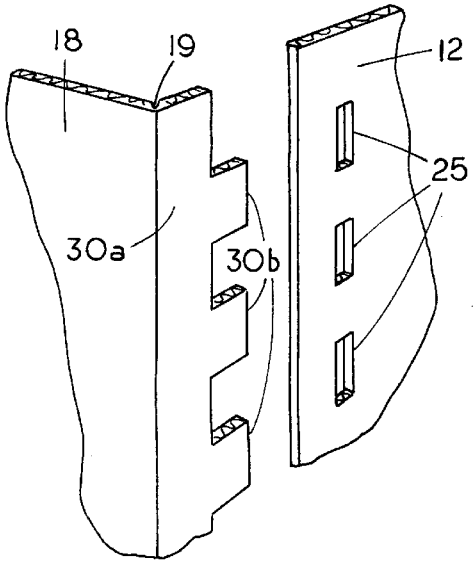
FIG. 6 is a partial perspective view showing a tab and slot method of securing a form of the form in position for use.

FIGS. 6, 7, 8, 9, and 10 show various alternative means of connecting the side edges 24 and 26 together. Specifically, FIG. 6 shows a main tab body 30*a* that includes a plurality of vertically spaced protrusions or fingers 30*b* that are mated with slots 25 cut in panel 12. When the form is erected, the fingers 30*b* are inserted into the slots 25.

Figure 7:
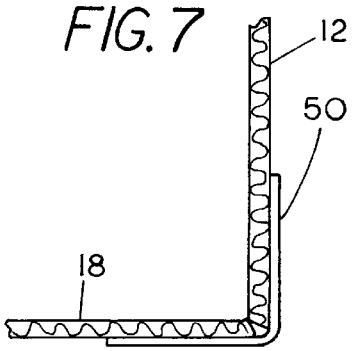
FIG. 7 is a partial top plan view showing a strip of tape for securing the vertical edges of the form in position for use.

FIG. 7 shows panels 12 and 18 without a tab 30. Here the edges of the panels 12 and 18 abut each other to form a corner that is held together by placing a strip of adhesive tape 50 along the edges adjacent the corner.

Figure 8:
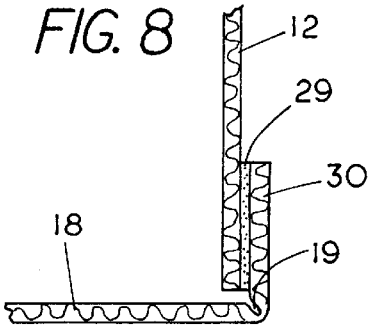
FIG. 8 is a partial top plan view showing an adhesive or welded method of securing the vertical edges of the form in position for use.

FIG. 8 shows tab 30 adhered to the face of panel 12 by means of an adhesive, a weld such as a sonic weld, or hook and loop fastener strips 29, e.g. Velcro®.

Figure 9:
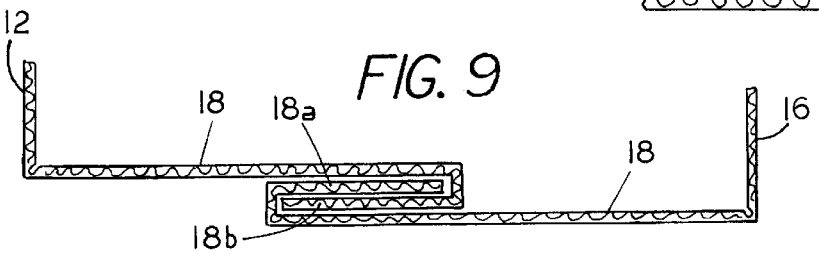
FIG. 9 is a partial top plan view showing an interlocking joint for placing the edges of the form in position for use.

FIG. 9 shows panels 12 and 18 without a tab 30. In this case each portion of panel 18 has a rigid 180°, i.e. U-shaped, bend at its free edge to provide two interlocking end panels 18*a* and 18*b*. During use, the two U-shaped end panels 18*a*, 18*b* are connected by being interlocked together as shown in FIG. 9. Interlocking is accomplished just before use by sliding each of the end panels 18*a* and 18*b* between a portion of panel 18 and the other end panel 18*a* or 18*b*.

Figure 10:
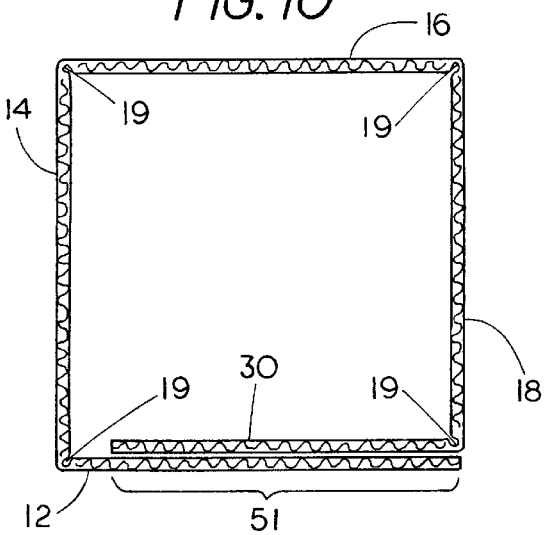
FIG. 10 is a plan view showing an overlap method for placing the edges of the form in position for use.
Figure 10A:
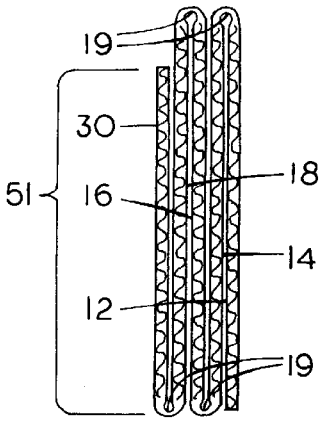
FIG. 10A is a top plan view of FIG. 10 folded for shipment or storage.
Figure 12:
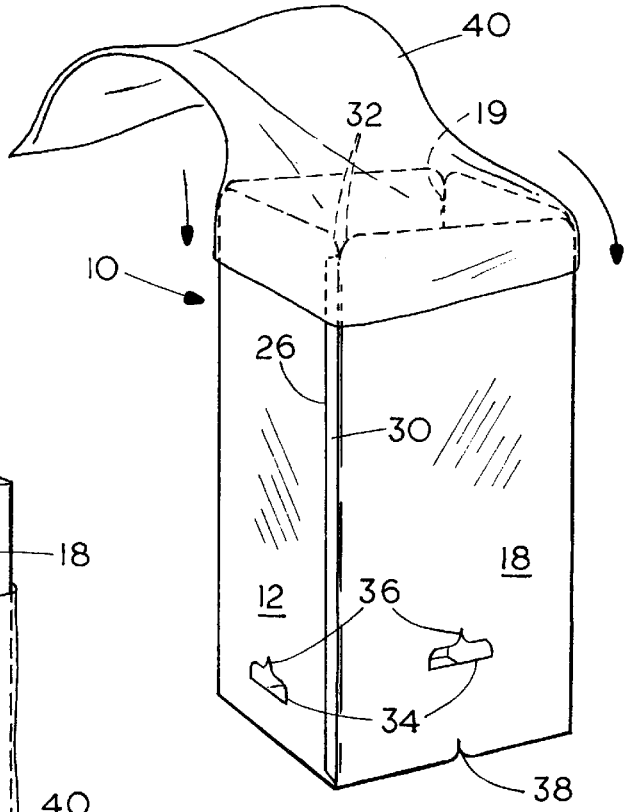
FIG. 12 is a perspective view of the invention as a plastic bag is being pulled in place for use.

FIG. 10 shows tab 30 and a portion of panel 12 placed adjacent to one another in overlapping relationship at 51, ready for use but not connected to one another. This embodiment can be readily collapsed by forming accordion folds as in FIG. 10A. In this embodiment, the form in effect has five panels. An important advantage of this embodiment is that the form can be readily collapsed to a compact bundle by forming accordion folds to facilitate storage and store display. The width and length of the tab or panel 30 can be reduced as much as desired, preferably by shortening it to reduce the cost of the package but yet allow the overlap indicated at 51 as well as providing enough space for the handhold 34 near the top of panel 12. Thus, to ship, display or store the form, the panels 12–18 are folded against one another as shown in FIG. 10A and the panel 30 is fold against panel 12. To insert the form of FIGS. 10 and 10A into a plastic bag 40, the form first is given a triangular shape by partially expanding the accordion-folded sheet 10 and placing it into the plastic bag, making sure that the rounded corners adjacent indentations 32 are at the bottom of the bag 40. Insertion can be accomplished by pulling the bag 40 over the form as shown in FIG. 12. After being placed upright, the form is expanded to the rectangular shape shown in FIG. 10, thereby completely filling the bag 40 which is then ready to receive leaves or other trash. It can be clearly seen in FIG. 10 that in the overlap area 51 the panel 18 and tab 30 are not connected but are merely placed adjacent to one another in overlapping relationship. This can be done by the user just before inserting the form into the bag 40.

Figure 11:
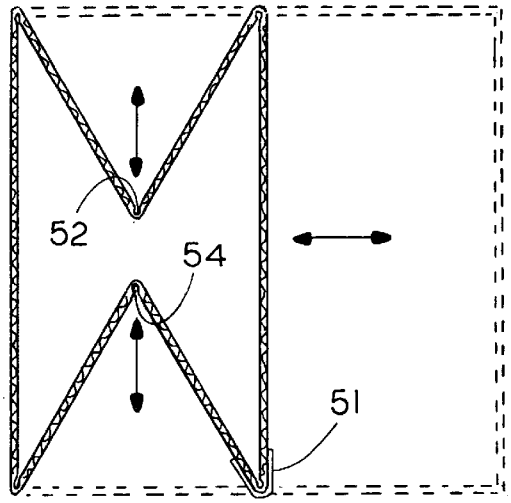
FIG. 11 is a plan view of the invention with free edges interlocked.

Since the tape 50 is difficult or impossible to remove from the corner once in place, other folding structures are provided to facilitate storage. The embodiment shown in FIG. 11 is provided an with additional pair of parallel external score lines 52 and 54 which enable the form to be folded, accordion-style, to a flat configuration which, because of its small size, facilitates storage, shipment and store display. The corner can be held in place using an adhesive means of bonding tab 30 to panel 12.

Figure 19:
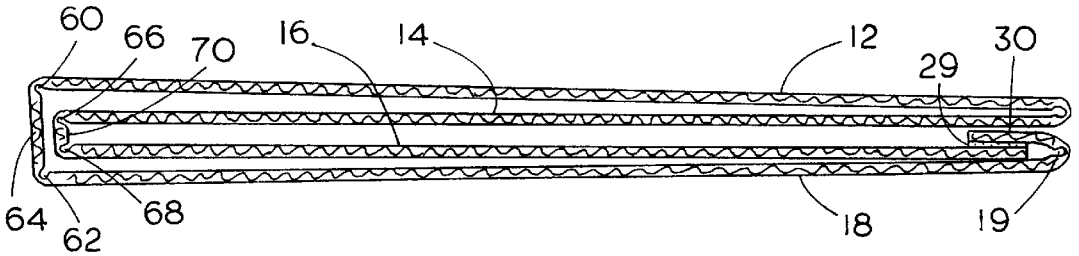
FIG. 19 is a plan view showing the invention folded into a compact bundle for storage.

The embodiment of FIG. 19 shows a single score line 19 forming tab 30. However, an adjacent second line 19 of the previous embodiments is replaced by two external score lines 66 and 68 made in close proximity to each other, i.e. a double score, to form a corner 70. An opposing previously described score line 19 is also replaced by two internal score lines 60 and 62 to define a double score, but these two score lines are slightly wider apart than the double-score lines 66, 68. It will thus be seen that double score lines 60, 62 enable a pair of adjacent panels 12 and 14 to be folded adjacent one another and placed between a pair of opposing panels 16, 18. Score lines 60 and 62 are provided to form a corner 64. The wider spacing between score lines 60, 62 enables the user to push corner 70 toward corner 64 until the two meet, thereby flattening the form for storage as shown in FIG. 19.

Figure 13:
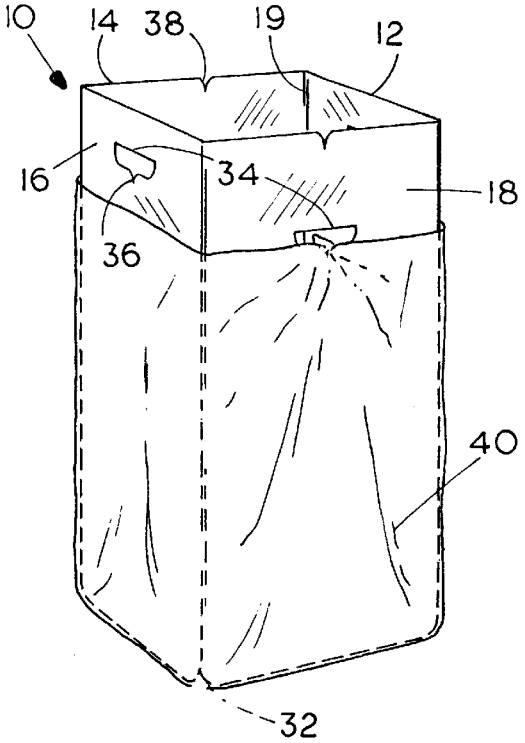
FIG. 13 is a perspective view showing the invention ready for use with a smaller size plastic bag.
Figure 14:
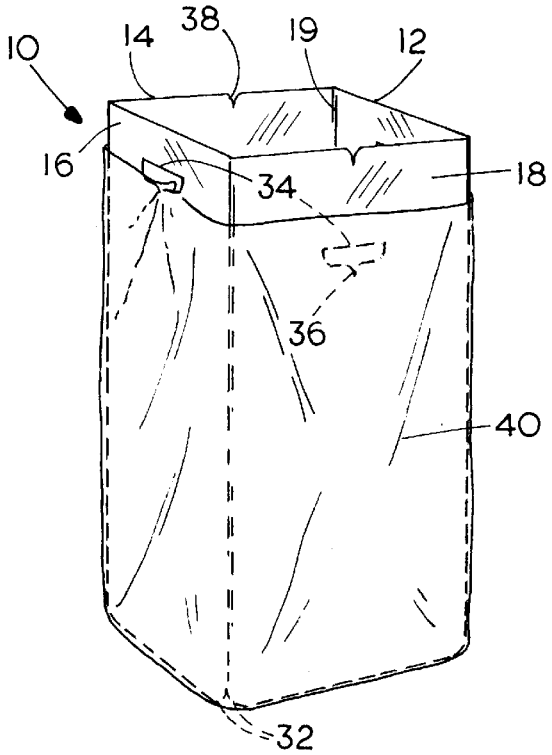
FIG. 14 is a perspective view showing the invention ready for use with a medium size plastic bag.
Figure 15:
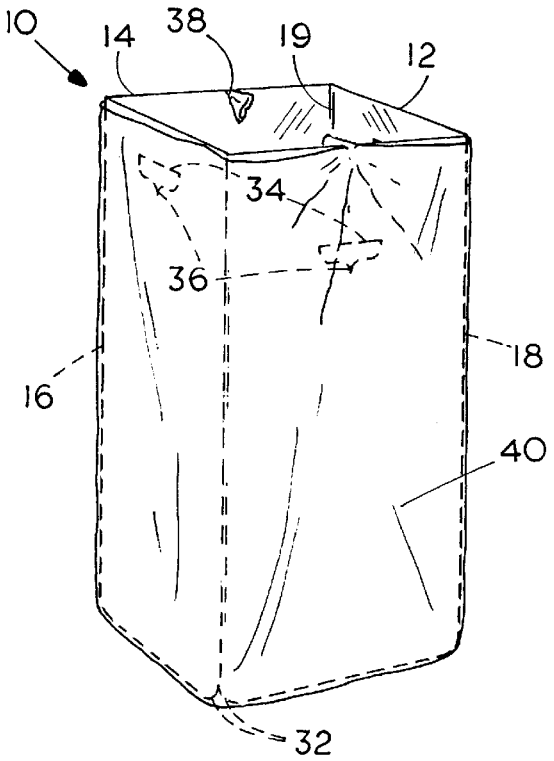
FIG. 15 is a perspective view showing the invention ready for use with a large size plastic bag.

FIGS. 13, 14, and 15 show how a single size holder can be used with three different size plastic trash bags now being sold: 33-, 39- and 45-gallon bags. FIG. 13 shows the bag holder and expander in use with a small bag. In this case the top edge of the bag is locked in place by being pinched in the slits 36 in the handholds 34 located the farthest distance from the top edge 20.

The bag depicted in FIG. 14 is a medium-sized bag, e.g. a 39-gallon bag, with its upper edge secured in the slits 36 in the handholds 34. In this case the user employs the handholds and slits 36 located closest to the top edge 20. In FIG. 15, a large bag, e.g. a 45-gallon bag, is shown with the slits 38 utilized to lock the bag in place.

Figure 16:
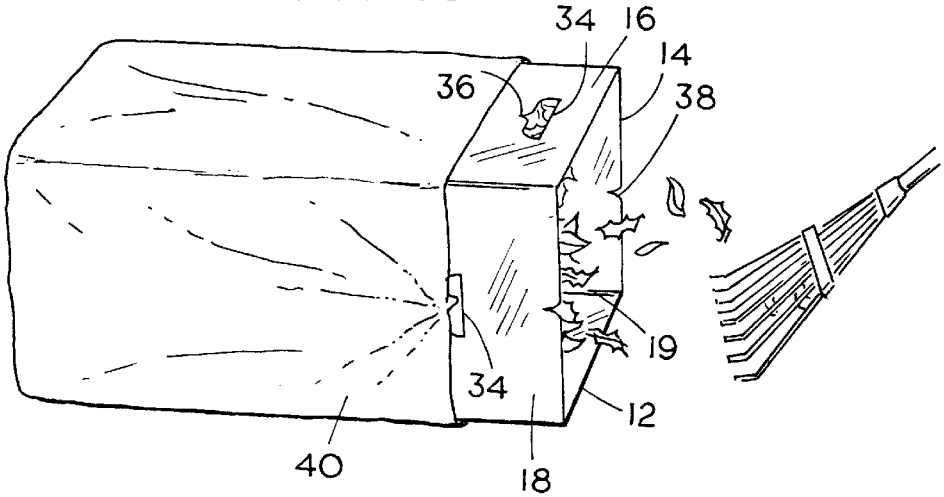
FIG. 16 is a perspective view showing the invention in use while lying on its side.
Figure 17:
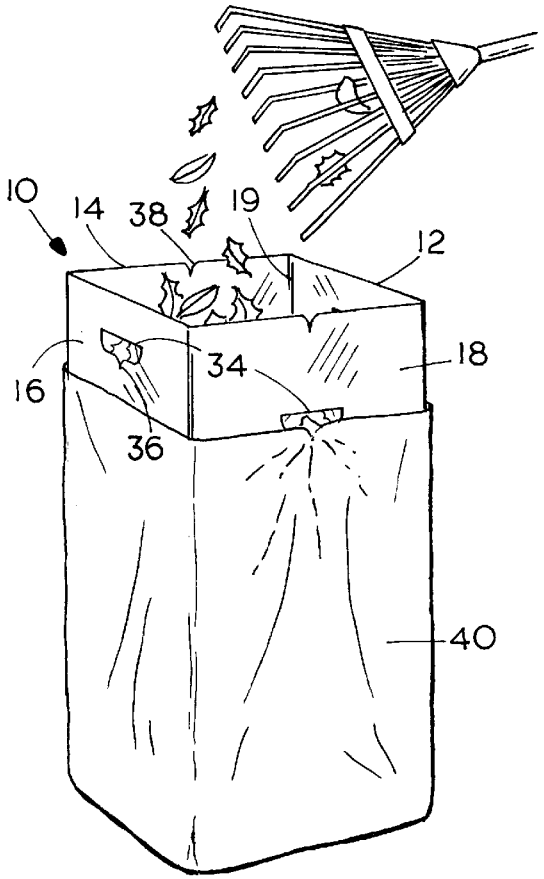
FIG. 17 is a perspective view showing the invention in use in an upright position.

FIGS. 12, 16, 17, and 18 show the invention in different stages of use. FIG. 12 shows the invention turned up-side-down to facilitate pulling of the bag 40 around the form. The rounded corners adjacent the indentations 32 enable the bag 40 to slide down onto the form without snagging on the corners and tearing the delicate plastic film. FIG. 16 shows a small bag mounted in place with the form and bag lying on one side. This configuration enables the user to easily sweep leaves into the bag opening. FIG. 17 shows how the bag can also be filled with the form in an upright position. In this figure, a small bag is again fixed on the form. In this case, the bag 40 is held upright while the user lifts the leaves into the bag. The stiff panels form a sturdy, box-like structure for holding the bag upright for easy filling.

Figure 18:
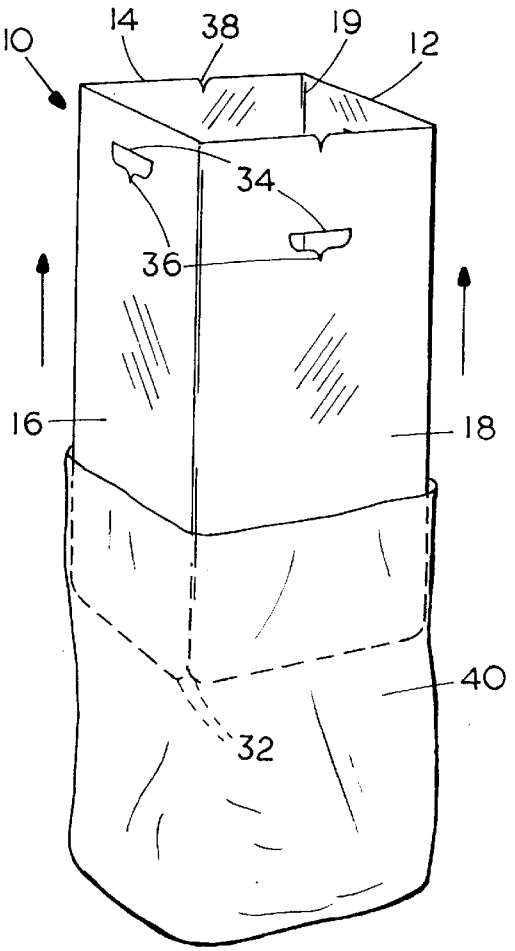
FIG. 18 is a perspective view showing the invention being removed from the bag after the bag has been filled.

Finally, in FIG. 18, once the bag is filled with leaves, the edges of the bag 42 are released from the slits 36 or 38, and the form is lifted out of the bag 40. The bag 40 can then be closed and, if desired, tied conventionally. The form can then either be placed in a new bag or folded into a compact bundle for later use.

Refer now to FIGS. 20–24 which illustrate another form of folding trash bag expanding form and holder 100 in accordance with the invention. In this case the form comprises rectangular blank 102 preferably formed from plastic corrugated board, corrugated high density polyethylene board, recycled plastic corrugated board, (all for convenience referred to simply as plastic corrugated board) or from corrugated cardboard, fiberboard or other stiff sheet material that includes at least three vertical rectangular panels 106, 108 and 110 which are hingedly connected by means of parallel creases or fold lines 112, 114, preferably formed by crushing the blank 102 to form vertically extending indentations or creases that define the fold lines 112, 114. The central panel 108 is provided with a hand hole 108*a* to facilitate inserting and removing the form 100 from a bag 120. If the bag 120 is a paper bag, no retaining slits are required. However, if the form 100 is to be used for a flimsy plastic bag, a pair of slits 121, 123 of the kind described above can be provided in the upper edges of the panels 106 and 110, respectively, of FIGS. 21 and 22 for pinching and retaining the upper edge of the bag 120 as already described.

FIGS. 20–23 show how any of the panels, for example panel 106, can be made up of two panels if desired, in this case 106*a* and 106*b* about equal in size, which are joined together by means of an optional lap joint comprising a weld, most preferably a sonic weld formed by applying pressure and sonic vibration to the plastic panels 106*a* and 106*b* that make up the full panel 106 until the plastic of the panels fuses to form the weld 106*d*. The panels 106*a* and 106*b* are thus rigidly bonded together by sonic weld 106*d*. The sonic weld 106*d* can be the same as already described hereinabove in connection with the tab 30 of FIG. 8. It was discovered that the sonic weld 106*d* will form a highly effective permanent bond allowing panels to be made from various size pieces or scrap material, thus conserving material and further reducing costs. The overlap at the sonic weld 106*d* also adds stiffness and strength to the panel 106.

Figure 21:
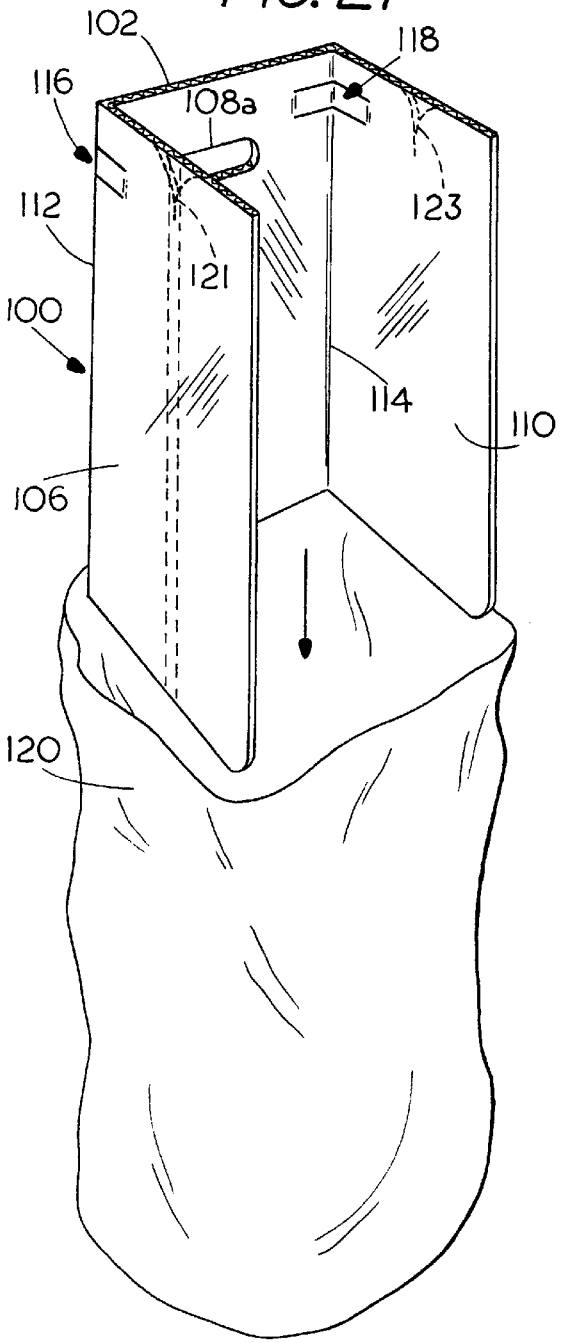
FIG. 21 is a perspective view showing the blank of FIG. 20 in the deployed configuration as it is being inserted into a trash bag.
Figure 22:
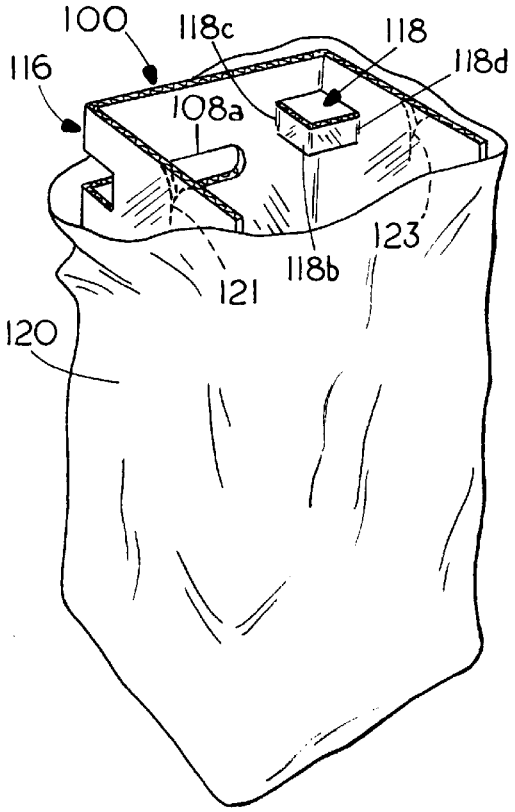
FIG. 22 is a perspective view showing the form and holder within the trash bag with braces in the deployed position.
Figure 23:
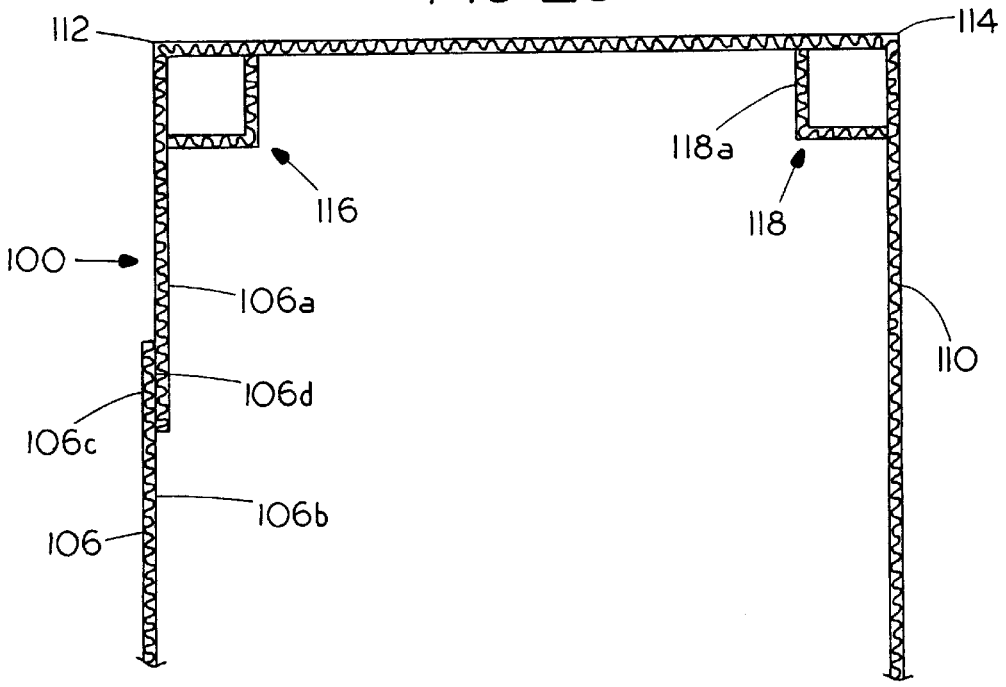
FIG. 23 is a top plan view of the trash bag expanding form and holder of FIGS. 20–22 ready for use.

When the form 100 is to be used, it is placed in the deployed position shown in FIGS. 21–23 with the panels 106, 110 parallel to one another and is then inserted into a trash bag 120 of any suitable known construction, preferably a paper composting bag of any of the commercially available kinds that are now in wide use. Form 100 is then slid into the bag 120 from the open end of the bag as shown in FIG. 21 until it assumes the position shown in FIG. 22, substantially entirely within the bag 120.

In the course of developing the present invention, it was found that the opposing panels 106, 110 tended to spread out or flop back and forth swinging either toward or away from one another, and can therefore be thought of as loose or unrestrained panels. Usually the panels 106, 110 would tend to spread apart from one another after being placed in the bag 120. This can cause the bag 120 to partially collapse or to form an asymmetrical shape, making it difficult to rake leaves into the open end of the bag. To prevent this, one or more positioning braces are provided, in this case two braces 116, 118 (FIG. 23), between the center panel 108 and the opposing side panels 106, 110. The braces 116, 118 are formed from tabs of sheet material, preferably the same sheet material that makes up the form 100. Braces 116, 118 are identical, so for convenience only the latter will be described in detail.

Figure 20:
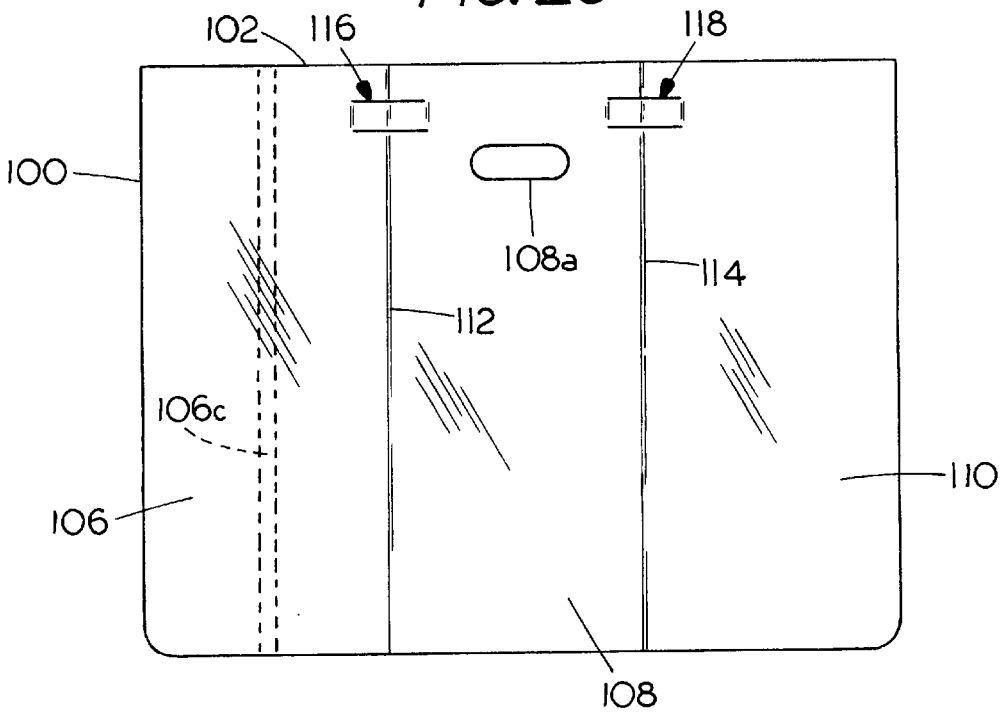
FIG. 20 is a plan view showing a blank for a folding trash bag expanding form and holder in accordance with another embodiment of the invention.
Figure 20A:
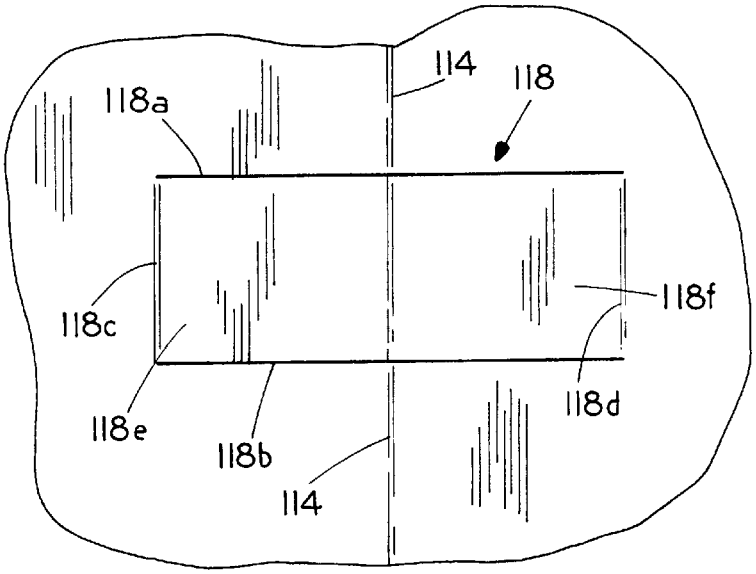
FIG. 20A is a partial view on a larger scale showing one of the braces of FIG. 20.
Figure 24:
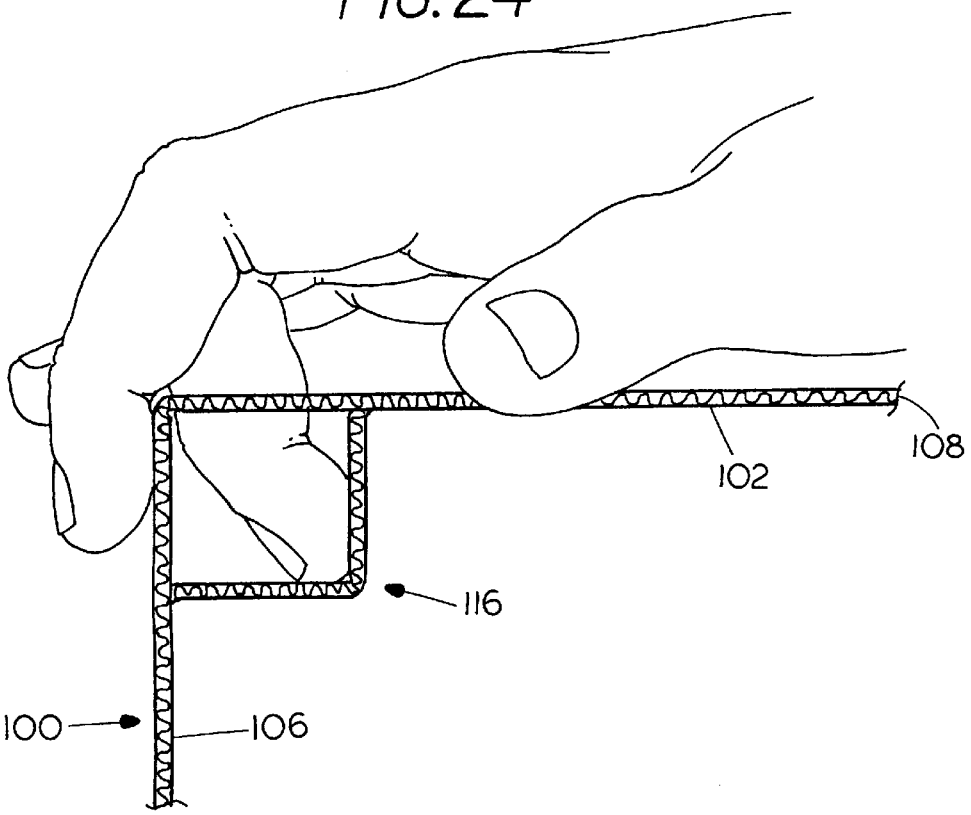
FIG. 24 is a top partial view on a larger scale showing the brace being deployed for use by applying manual pressure.

Brace 118 is defined by a pair of laterally extending, horizontally disposed, vertically spaced apart slits 118*a,* 118*b* through the sheet 102 adjacent the fold line 114. The ends of the slits 118*a,* 118*b* are connected by means of vertical fold lines 118*c,* 118*d* (FIG. 20A) which form the outer edges of a pair of adjacent tabs 118*e,* 118*f* that intersect along fold line 114. Similarly, the brace 116 is positioned adjacent fold line 112 so that the slits cross through the fold line 112. In this way, a pair of bi-stable braces 116, 118 are formed that are able to snap inwardly when pressure is applied manually from the outside as shown in FIG. 24. It was found that each of the braces 116, 118 is deformable, so that when finger pressure is applied the brace snaps centrally with a kind of toggle action as the center portion of the brace adjacent the fold line 112 or 114 is forced to pass centrally to a stable over-center position extending toward the interior of the form 100. In this position, the braces 116, 118 resist movement of the free edges of panels 106, 110 either toward or away from one another, thus acting to brace the form 100 so that is assumes the U-shaped position of FIGS. 21–24 with the panels 106, 110 parallel to one another. The bracing produces a space or gap between the free edges of the panels 106, 110 that is preferably substantially equal to the distance between the side edges of the panel 108 between fold lines 112 and 114.

The form 100 is highly effective even though it has only three panels. While an additional fourth panel could be provided if desired, the raw material cost of the unit would be increased about one-third. The form 100 is also very easy to use. It is first placed in the bag 120 as shown in FIGS. 21–22. The braces 116, 118 are then snapped centrally by applying finger pressure as shown in FIG. 24 to stabilize the form 100 with the panels 106, 110 in opposing parallel relationship so as to reliably hold the bag 120 in the desired open configuration.

Figure 25:
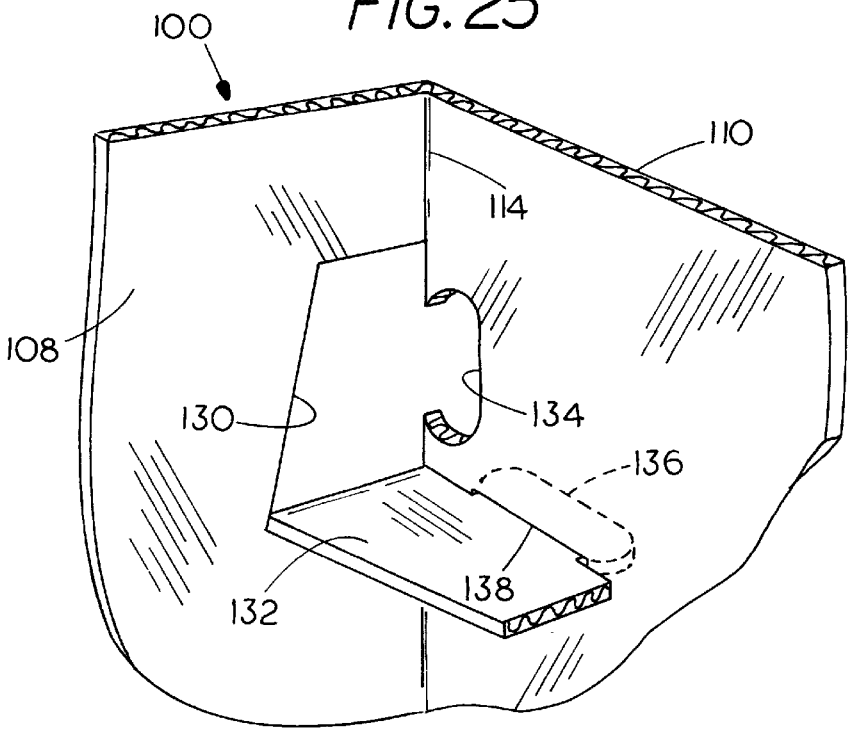
FIG. 25 is a perspective view of another form of brace in accordance with the invention.

Refer now to FIG. 25 which illustrates another form of brace in accordance with the invention. In this case an opening 130 is cut in the panel 108 to form a tab 132 which is folded forwardly along a fold line at its lower edge to a horizontal position as shown. The opening 130 includes a cut-away portion 134 in the panel 110 that forms a tongue 136 that is placed by the user through a slit 138 in panel 110. The tab 132 when moved to the operative position of FIG. 25 with the tongue 136 extending through slit 138 will hold the panel 110 at a right angle with respect to the panel 108. A tab similar to the tab 132 can be provided between the panel 108 and the panel 106.

Figure 26:
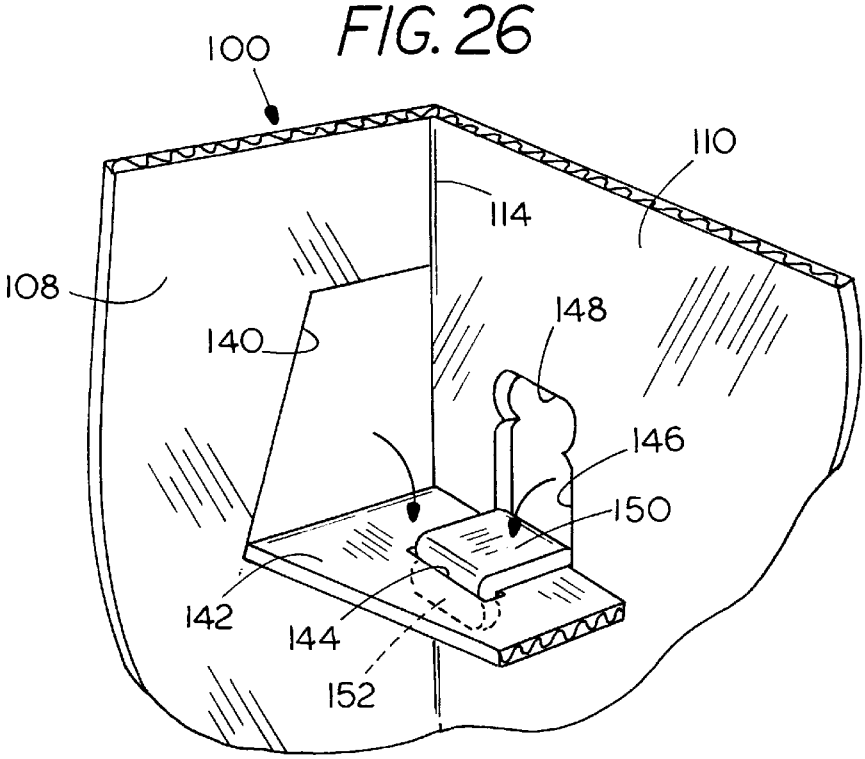
FIG. 26 is a perspective view of still another form of brace in accordance with the invention.

Refer now to FIG. 26 which illustrates another embodiment of the invention. In this case, an opening 140 is cut in the panel 108 to form a tab 142 which is folded along a fold line at its lower edge to a horizontal position during use so as to extend forwardly alongside the side panel 110. A second tab 150 is formed by cutting an opening 146 in panel 110. The opening 146 has an upper extension 148 that defines a tongue 152 which, when the tab 150 is folded to a horizontal position, is passed through a slit 144 in the tab 142, thereby reliably holding the panels 108 and 110 at a right angle to one another.

The braces shown in FIGS. 25 and 26 are not preferred embodiments, since they are more complicated in construction and require a greater effort on the part of the user to place them in the operative position. By contrast, the embodiment of FIGS. 20–24 requires only the flick of a finger to snap the braces forwardly into the operative position of FIGS. 22–24.

The form 100 of FIGS. 20–26 is rugged in construction, reliable in operation, and economical to manufacture, since the raw material costs are only about 75% of forms requiring four panels. Moreover, the form 100 can be manufactured from smaller pieces with a sonic weld 106*d* connected between panels 106*a* and 106*b*. This gives the form 100 as much stiffness and strength as needed. In addition, the braces 116, 118 or those of FIGS. 25 and 26 will reliably hold the side panels 106, 110 at a substantially right angle to the center panel 108 so as to prevent the bag 120 from collapsing while it is being filled with leaves. After the bag 120 has been filled, the form 100 can be easily withdrawn using the hand hole 108*a*.

Many variations of the present invention within the scope of the appended claims will be apparent to those skilled in the art once the principles described herein are understood.

What is claimed is:

1. A folding trash bag expanding form and holder, comprising:

at least three panels formed from stiff sheet material joined to one another by a pair of parallel vertically extending fold lines to enable the panels to provide an expander having a plurality of panels that can be folded with respect to one another to expand a trash bag, said form and holder comprising a sheet of plastic corrugated board and said plastic corrugated board has a pair of overlapping edges that are rigidly bonded together by a sonic weld.

2. The expanding form and holder of claim 1 wherein means are connected between at least two of the panels to hold the panels in predetermined angular relationship while the form is in an operational configuration located within the bag to help maintain the bag in an expanded condition.

3. The expanding form and holder of claim 1 wherein the holder includes at least one brace between adjacent panels, said brace is formed from said sheet of plastic corrugated board and said brace includes a pair of tabs connected to adjacent panels of the holder and intersecting with one another.

4. The form of claim 3 wherein the brace comprises a section of said sheet material defined between a pair of upper and lower substantially parallel, horizontally extending, vertically spaced apart slits, fold lines join each pair of adjacent ends of said slits, said brace is bi-stable and is capable of being snapped inwardly when pressure is applied manually to an outside surface thereof so as to be deflected centrally with a toggle action as a center portion of the brace is forced to pass to a stable, over-center position that resists movement of the opposing side panels either apart or toward one another.

5. A folding trash bag expanding form and holder, comprising:

three panels formed from stiff sheet material and joined to one another by a pair of parallel vertically extending fold lines to enable the panels to provide an expander having a pair of loose, diametrically opposed panels on each side of a central panel, and deployable brace members extending between the centrally located panel and the loose panels adjacent the fold lines for supporting the loose panels in opposing relationship confronting one another.

6. The form of claim 5 wherein the braces are deployable manually from an inactive to an operational position extending between said panels.

7. The form according to claim 5 wherein the braces are formed from said stiff sheet material.

8. The form of claim 5 wherein at least one brace is provided for each of said fold lines and each of the braces comprises a pair of tabs hingedly connected to adjacent panels on either side of an adjacent fold line, and said tabs are connected together for holding the panels adjacent thereto in predetermined angular relationship.

9. The form and holder of claim 8 wherein the predetermined angular relationship is substantially a right angle so as to hold the panels in a substantially parallel relationship confronting one another.

10. The form of claim 5 wherein the brace comprises a section of the sheet material defined between a pair of upper and lower substantially parallel, horizontally extending, vertically spaced apart slits adjacent a fold line join each pair of adjacent ends of said slits, said brace is bi-stable and is capable of being snapped inwardly when pressure is applied manually to an outside surface thereof so as to be deflected centrally with a toggle action as a center portion of the brace is forced to pass inwardly to a stable, over-center position that resists movement of the opposing side panels either apart or toward one another.

* * * * *